US005818012A

United States Patent [19]

Maniero

[11] Patent Number: 5,818,012

[45] Date of Patent: Oct. 6, 1998

[54] SELF-REGULATING CABLE ASSEMBLY

[75] Inventor: Daniel A. Maniero, Mokena, Ill.

[73] Assignee: Wrap-On Company Inc., Bedford Park, Ill.

[21] Appl. No.: 647,382

[22] Filed: May 9, 1996

[51] Int. Cl.[6] ..... H05B 1/02

[52] U.S. Cl. ..... 219/506; 219/487; 219/535; 439/417

[58] Field of Search ..... 219/505, 506, 219/507, 482, 487, 489, 491, 535, 538, 544; 439/98, 106, 415–417, 467, 622, 695–697; 338/214

[56] References Cited

U.S. PATENT DOCUMENTS

| | | | |
|---|---|---|---|
| 2,625,643 | 1/1953 | Cordis | 219/535 |
| 4,520,417 | 5/1985 | Frank | 361/45 |
| 4,810,859 | 3/1989 | Anabtawi et al. | 219/535 |
| 4,822,983 | 4/1989 | Bremner et al. | 219/505 |
| 5,002,501 | 3/1991 | Tucker . | |
| 5,004,432 | 4/1991 | Tucker . | |
| 5,252,081 | 10/1993 | Hart . | |
| 5,451,747 | 9/1995 | Sullivan et al. | 219/528 |

*Primary Examiner*—Tu B. Hoang
*Attorney, Agent, or Firm*—Brinks, Hofer, Gilson, & Lione

[57] ABSTRACT

An improved self-regulating pipe heating cable assembly that includes a self-regulating cable having a temperature-sensitive conducting layer between a pair of busses and a plug coupled to a first end of the self-regulating cable for supplying electricity thereto. The improved self-regulating pipe heating cable assembly includes an indicator coupled to the self-regulating cable at a location other than where the plug is connected. The indicator is responsive to the supply of electricity to the self-regulating cable so that proper operation of the self-regulating heating cable assembly can be determined.

36 Claims, 2 Drawing Sheets

SELF-REGULATING CABLE ASSEMBLY

BACKGROUND OF THE INVENTION

The present invention relates to self-regulating heating cable assemblies.

Self-regulating heating cables are widely used to prevent water conveyed through supply pipes from freezing. When water freezes in supply pipes, there is the inconvenience of a disruption in the supply of water. In addition, when water freezes in a supply pipe, it is possible that the pipe will burst. Accordingly, homeowners and businesses have wrapped electric heating cables around water supply pipes, especially in unheated areas, to prevent freezing.

One type of widely used heating cable is self-regulating. The self-regulating type of cable is installed on a water supply pipe and left on the pipe permanently. The self-regulating type of cable includes two conductor busses that are encased in an insulating jacket. Around the conductor busses is a layer of a material that has a variable conductivity that is temperature-dependent. The material has a higher conductivity when cold and a lower conductivity when warm. In addition, the material has a resistivity such that heat is generated when a current flows through the material. The cable is connected to a conventional electrical supply to cause an electrical potential across the conductor busses. Then, when the ambient temperature around the supply pipe is warm and the material layer has a relatively low conductivity, relatively little current can pass across the material layer. Therefore, relatively little heat is generated by the small flow of current in the busses and through the material layer. However, when the ambient temperature is cold, the conductivity of the material layer increases. This permits more current to flow through the busses and across the material layer. This increased level of current flow generates heat which in turn heats the pipe around which the cable is wrapped.

Self-regulating heating cables have the advantage of operating automatically, as needed, whenever the temperature becomes cold. A potential disadvantage of self-regulating heater cables has been that the installer has not had a way to determine whether the cable is functional when it is being installed or after it has been in place for several weeks or years. Self-regulating cables are occasionally installed on-site where the cable is cut to length. If the cable is damaged during installation or if the cable or plug is defective, the problem may not be discovered until the water in the pipe freezes.

Accordingly, it is an object of the present invention to provide an improved self-regulating heating cable that provides an indication whether it is functional.

SUMMARY OF THE INVENTION

To achieve the foregoing and other objectives and in accordance with the purposes of the present invention, there is provided an improved self-regulating pipe heating cable assembly. The improved assembly includes a self-regulating cable having a temperature-sensitive conducting layer between a pair of busses and a plug coupled to a first end of the self-regulating cable for supplying electricity thereto. The improved self-regulating pipe heating cable assembly includes an indicator coupled to the self-regulating cable at a location other than where the plug is connected. The indicator is responsive to the supply of electricity to the self-regulating cable so that proper operation of the self-regulating heating cable assembly can be determined.

DETAILED DESCRIPTION OF THE PRESENTLY PREFERRED EMBODIMENTS

Figure 1:
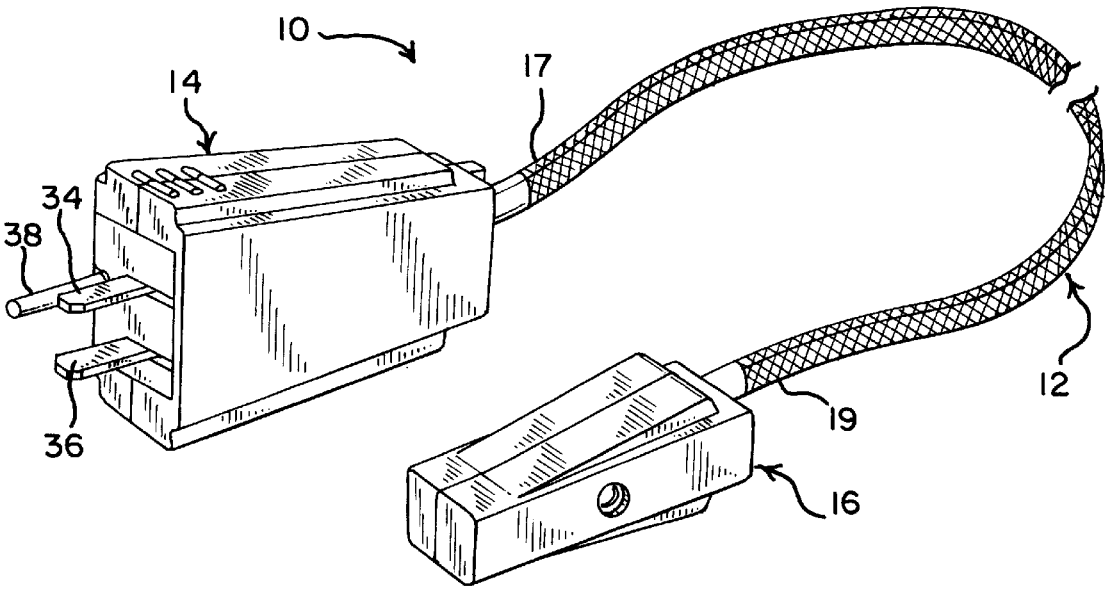
FIG. 1 is a perspective view of a first embodiment of a self-regulating heating cable assembly.

Referring to FIG. 1, there is shown a first embodiment of a self-regulating heating cable assembly 10. The self-regulating heating cable assembly 10 is formed of a self-regulating heating cable 12, a plug portion 14, and an indicator portion 16. The plug portion 14 is connected to a first end 17 of the cable 12 and the indicator portion 16 is connected to the second end 19 of the cable 12.

Figure 2:
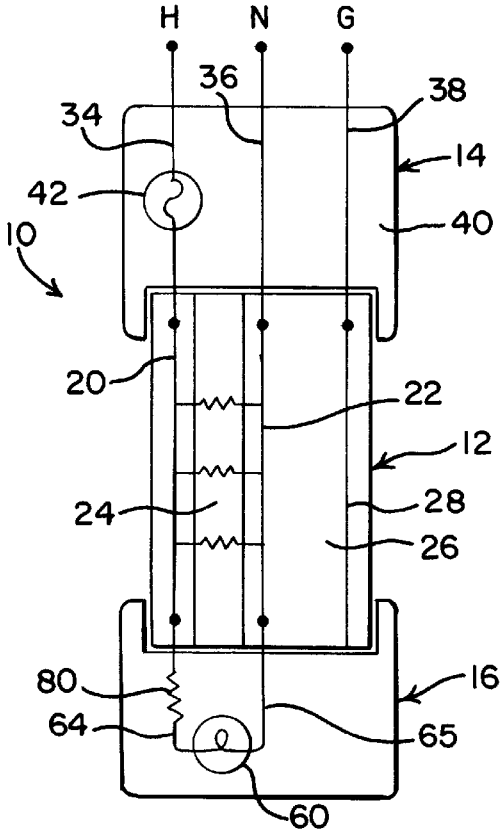
FIG. 2 is an electrical diagram of the self-regulating heating cable assembly of FIG. 1.

FIG. 2 shows an electrical diagram of the self-regulating cable assembly 10. The self-regulating cable 12 includes a first bus 20 and a second bus 22. Each of these busses is formed of a continuous length of a conductive material.

Figure 3:
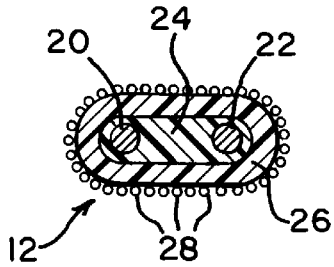
FIG. 3 is a cross sectional view of the self-regulating heating cable of FIG. 1.

FIG. 3 shows a cross sectional view of the self-regulating cable 12. The first bus 20 and second bus 22 are separated and surrounded by a polymeric layer 24. The polymeric layer 24 has a variable resistance that increases with temperature so that the layer 24 has a lower resistance when the temperature is cold and a higher resistance when the temperature is warm (i.e. "self-regulating"). The material from which the polymeric layer 24 is composed has sufficient resistance so that heat is produced when current passes through the polymeric layer. In one embodiment, the cable 12 produces approximately 3 watts per linear foot of cable. The busses 20 and 22 and the layer 24 are encased in an insulating jacket 26. The insulating jacket 26 is surrounded by a sheath or braid 28 of a conductive material. The braid 28 is used as a ground. Suitable self-regulating cables include PIPE-GUARD from the Wrap-On Company and SAFE-T-WRAP from Chromalox. Other types of self-regulating heating cables may be used, as well as self-regulating heating cables from other manufacturers. Use of these other type and brands of self-regulating heating cables is regarded to be included within the scope of the present invention.

Referring again to FIGS. 1 and 2, the plug portion 14 is used to connect the self-regulating cable assembly 10 to a source of electrical energy. Typically, the source of electrical energy would be available at a conventional electrical outlet receptacle, and therefore, the plug portion 14 is suitably adapted for connection to a conventional electrical outlet receptacle. The plug 14 includes a first conductor 34, a second conductor 36, and a third conductor 38. These conductors are separated by an insulating material that may also form the plug housing 40. The plug portion 14 provides suitable means for making a mechanical connection to the self-regulating cable 12, and for making electrical connections between the first conductor 34 and the first bus 20, between the second conductor 36 and the second bus 22, and between the third conductor 38 and the ground braid 28. In a present embodiment, the conductors 34, 36, and 38 also extend from the plug housing 40 to form the prongs that can be inserted into the conventional electrical receptacle.

The plug portion 14 also preferably includes a fuse 42. The fuse 42 is located in series with one of the conductors, such as the conductor 34. The fuse 42 may be removable or may be non-removable, i.e., hard-wired or soldered in place. In a present embodiment, the fuse 42 has a rating of 7 amp. A suitable fuse is part number R473007 manufactured by Littlefuse. Fuses of other ratings and fuses by other manufacturers would also be suitable.

Figure 4:
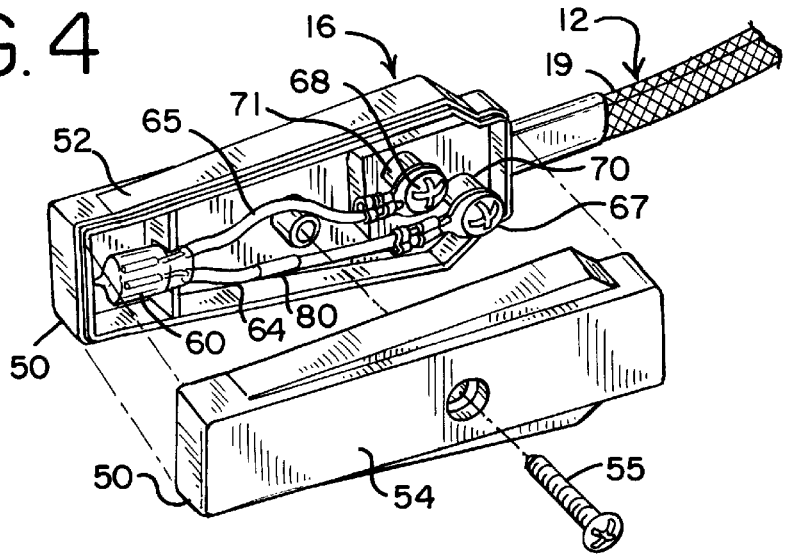
FIG. 4 is a perspective exploded view of the indicator portion of FIG. 1.
Figure 5:
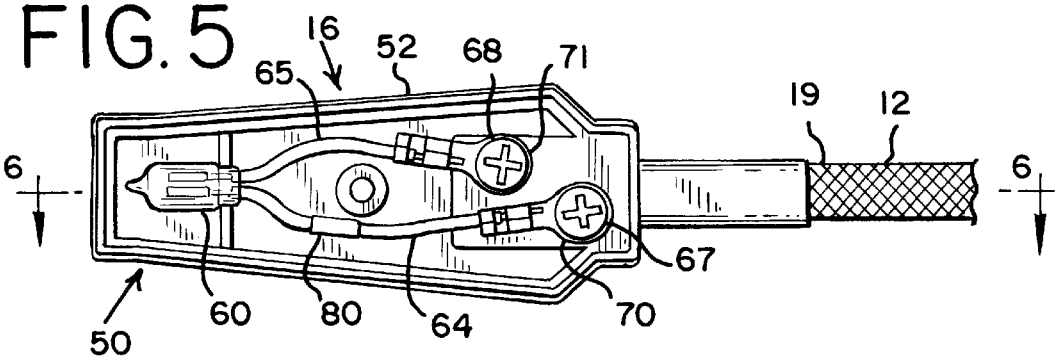
FIG. 5 is a side view of the housing base of the indicator portion of FIG. 4.

As mentioned above, the indicator portion 16 is connected to the self-regulating cable 12. The indicator portion 16 connects to the self-regulating cable 12 at a location other than the location at which the plug 14 is located. Referring to FIG. 4, the indicator portion 16 includes an indicator housing 50. The indicator housing 50 is formed of an indicator housing base 52 and an indicator housing cover 54. The indicator housing base 52 and indicator housing cover 54 are connected together by a suitable fastening means 55, such as a screw, nut-and-bolt, snap-fit, latches, and so on.

Figure 6:
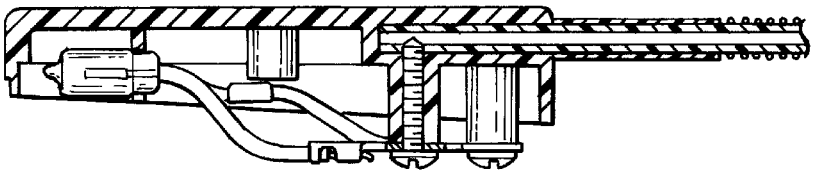
FIG. 6 is a side sectional view of the housing base taken along line 6—6' of FIG. 5.
Figure 7:
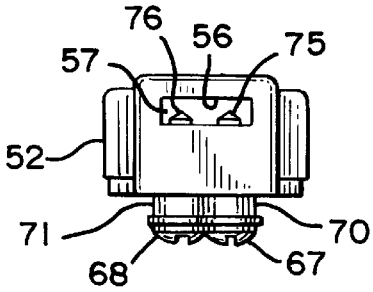
FIG. 7 is an end view of the housing base of FIG. 5, shown without the cable.

The indicator portion 16 includes suitable means for receiving the self-regulating cable 12. In the embodiment shown in FIGS. 4–7, the self-regulating cable 12 is received in the indicator housing base 52. As shown in FIG. 7, the indicator housing base 52 includes an opening or aperture 56 in a proximal end thereof. Referring to FIG. 6, the opening 56 provides access to a slot or recess 57 in the indicator housing 50 into which the end 19 of the self-regulating cable 12 can be received. In a present embodiment, the recess 57 is approximately 0.75 inches in length and permits the end 19 of the cable 12 to be received therein.

The opening 56 preferably has an other-than-round shape, and in a preferred embodiment, the aperture 56 has a shape that conforms generally to the shape of the self-regulating cable 12. As shown in FIG. 3, the self-regulating cable 12 has an oval cross sectional profile having dimensions of approximately 0.25 by 0.125 inches. The aperture 56 in the indicator housing base 52 has a generally rectangular shape that permits the self-regulating cable 12 to be inserted into the indicator base 52 in a fixed orientation. In a present embodiment, the dimensions of the aperture 56 are approximately 0.30 by 0.130 inches. Alternatively, the aperture 56 may have other shapes and dimensions. Further, the aperture 56 may even have a symmetrical shape, such as circular or square, and the indicator portion 16 may have other means to orient the cable 12 to make connection to the cable busses 20 and 22.

The indicator portion 16 also includes an indicator or signal 60. In one embodiment, the indicator 60 is a visual indicator, such as a lamp bulb. In one embodiment, the lamp bulb may be a neon lamp assembly, part number 950717, manufactured by GBC, Inc. of Ocean, N.J. Other types of lamps and lamps by other manufacturers would also be suitable.

The indicator 60 is adapted to be responsive to a voltage potential across the busses 20 and 22, or to a current through the busses 20 and 22. By being responsive to a voltage potential across the busses or a current through the busses at a location other than at the plug portion 14, the indicator 60 can provide a signal indicating whether the self-regulating cable assembly is functioning properly.

In a preferred embodiment, the indicator 60 is electrically connected across the busses 20 and 22. The indicator portion 16 includes means for making an electrical connection between the busses 20 and 22. For example, the indicator portion 16 includes lead wires 64 and 65 that connect to the indicator light 60. In a present embodiment, the electrical connection between the cable busses 20 and 22 and the indicator 60 is made by first and second screws 67 and 68. The first and second screws 67 and 68 are made of a conductive material. The screws 67 and 68 are threadably received in mating holes in posts 70 and 71 formed in the housing base 52. The holes in posts 70 and 71 provide access to the recess 57 in which the end of the self-regulating cable is retained. First and second tips 75 and 76 of first and second screws 67 and 68 penetrate the insulation jacket 26 of the self-regulating cable 12 to make electrical connection with the busses 20 and 22.

A resistor 80 is located in series with the indicator lamp 60. The resistor may have a rating of 33 K ohms at ¼ watt. The resistor 80 limits the flow of current through the lamp 60.

The self-regulating heater cable assembly 10 may be provided pre-assembled, or the self-regulating heating cable assembly may be assembled on-site. An advantage of assembling the self-regulating heater cable assembly 10 on-site is that the cable portion 12 can be cut to a desired length. The self-regulating heating cable assembly 10 may be assembled and installed by consumers, or by technicians, construction workers, service workers, installers, etc. To assemble and install the self-regulating heating cable assembly 10, the cable portion 12 is cut to a desired length. The cable may be cut to any suitable length. For example, in one present embodiment, the self-regulating cable is cut to a length of approximately 50 feet or less. (In alternative embodiments, the self-regulating cable may be cut to lengths of greater than 50 feet, or even 100 feet or more. If self-regulating cable is used in lengths greater than approximately 50 feet, a fuse 42 of a different rating may be used.) One end 17 of the cable 12 is placed in proximity to an electrical outlet. The cable 12 is wrapped around the pipe to be heated. The indicator portion 16 is connected to other end 19 of the cable 12 away from the electrical outlet. To install the indicator portion 16, the ground braid 28 is pushed back slightly to expose the insulating jacket 26. The cable portion is inserted into the recess 57 of the indicator housing 50 through the aperture 56. Because the aperture 56 has a shape that conforms to the cable portion 12, the cable 12 is retained in a desired orientation. In this orientation, the tips 75 and 76 of the first and second screws 67 and 68 are aligned with the busses 20 and 22 in the cable portion 12 so that when the screw tips 75 and 76 are advanced into the cable 12 through the insulating jacket 26, they make contact with the busses 20 and 22, respectively.

The installer then connects the plug portion 14 to the other end 17 of the cable 12 opposite from the indicator portion 16. Connection of the plug portion 14 to the cable 12 may be accomplished in a manner similar to connection of the indicator portion 16. When the plug portion 14 is connected to the cable 12, the plug portion 14 is inserted into a conventional electrical receptacle. At this time, the assembly 10 can be tested. The assembly 10 can be tested by observing the indicator 60. The indicator 60 is responsive to a potential between the busses 20 and 22 or to a current through the busses 20 and 22. Thus, if all the connections have been properly made and all the components are in working order, the indicator 60 should provide a signal. If the indicator 60 is a light, the light should be glowing. If the indicator is not on, it is an indication that there is no potential between the busses 20 and 22 or that there is no current reaching the indicator 60. The installer can then check for a defective component or a loose connection.

The indicator light 60 will operate (i.e., be "on" or glow) even if the ambient temperature is warm and the temperature-dependent layer 24 of the self-regulating cable 12 effectively prevents the cable 12 from generating significant heat. The indicator 60 operates regardless of the ambient temperature because it is connected directly to the busses 20 and 22 of the cable 12. Thus, when the ambient temperature is warm and relatively little current is flowing through the cable 12 due to the high resistance of the layer 24, there is still sufficient potential across the busses 20 and 22 in the cable at the indicator 60 to determine whether the cable is functional. The indicator 60 will also operate (and thereby show whether the cable is functioning) when the ambient temperature is cold. Because the current path through the light 60 has sufficiently low resistance, at least a portion of the current through the cable 12 will pass through the indicator light 60 even if a significant amount of current is passing across the temperature-dependent layer 24. In this manner, one can tell whether the self-regulating cable assembly is functioning regardless of the ambient temperature.

In the above embodiment, the indicator 60 was described as a visual indicator, such as a light. In alternative embodiments, the indicator 60 can provide an audible signal, such as a beep or whistle. Also, the indicator may be continuous or intermittent. For example, the indicator may be a light that flashes periodically to indicate that the cable is functioning, or an audible indicator that beeps periodically. Periodic operation my be provided by charging and discharging of a capacitor located adjacent to the indicator. Still further, the indicator may provide a radio or wireless communication signal. A radio transmitter indicator would allow the indicator to be monitored remotely.

In other embodiments, the indicator may be switched. For example, a tester switch may be located adjacent to the indicator. Upon closing the tester switch, the indicator would operate. For example, upon pressing the tester switch, the indicator may flash or emit an audible sound.

In a present embodiment, it is understood that these components may be sold or provided as a kit. In one embodiment the indicator is part of a kit of components that includes the plug with the heating cable sold separately. Alternatively, the kit may also include the cable, or any combination of these components. Still further, these components may be sold separately, and the separate sale of these components is also regarded to come within the scope of the present invention. For example, the indicator may be sold or provided separately from the plug and/or heater cable. Further, retrofitting heating cables with indicators is considered to come within the scope of the present invention.

The above embodiment describes locating the indicator at an opposite end of a heater cable from the plug portion. In alternative embodiments, the indicator may be located along the length of the cable. Still further, the indicator may be connected between lengths of heater cable that are connected together.

In the above embodiments, the indicator was described as being responsive to a potential across the busses or a current through the buses. In alternative embodiments, the indicator may be responsive to the supply of electricity by other means, such as by sensing inductance or fields around the cable.

It is intended that the foregoing detailed description be regarded as illustrative rather than limiting and that it is understood that the following claims including all equivalents are intended to define the scope of the invention.

I claim:

1. A self-regulating pipe heating cable assembly comprising:

a self-regulating cable having a first bus, a second bus, and a temperature-sensitive conducting layer between said first bus and said second bus;

a plug coupled to a first end of said of self-regulating cable for supplying electricity thereto, said plug adapted for insertion into an electrical receptacle; and an indicator coupled to said self-regulating cable at a second end of said self-regulating cable, wherein said second end is opposite from said first end.

2. A kit of components for assembling a self-regulating heating cable assembly wherein the kit is adapted for use with a length of self-regulating heating cable adapted to draw increased current at lower temperatures to generate heat therefrom, the kit including:

a plug adapted for coupling to a first end of said length of self-regulating cable for supplying electricity thereto, said plug also adapted for insertion into a conventional electrical receptacle; and an indicator adapted for coupling to said self-regulating cable at a location along the length of said self-regulating heating cable between said first end and a second end opposite from said first end, said indicator responsive to operation of said self-regulating heating cable.

3. The self-regulating heating cable assembly of claim 1 wherein said indicator is a visual indicator.

4. The self-regulating heating cable assembly of claim 1 wherein said indicator is a lamp.

5. The self-regulating heating cable assembly of claim 1 wherein said indicator is connected across said first bus and said second bus.

6. The self-regulating heating cable assembly of claim 1 wherein said indicator includes means responsive to current in said first bus and said second bus.

7. The self-regulating heating cable assembly of claim 1 wherein said indicator includes means responsive to a potential across said first bus and said second bus.

8. The self-regulating heating cable assembly of claim 1 wherein said indicator turns on if current flows through said cable.

9. The self-regulating heating cable assembly of claim 1 wherein said indicator turns off if electricity is not supplied thereto through said cable.

10. The self-regulating heating cable assembly of claim 1 further comprising a fuse in series with at least one of said first bus and said second bus.

11. The self-regulating heating cable assembly of claim 10 wherein said fuse is located at said plug.

12. The self-regulating heating cable assembly of claim 1 further comprising a resistor in series with at least one of said first bus and said second bus and wherein said resistor is located at said indicator.

13. The self-regulating heating cable assembly of claim 1 wherein said self-regulating cable further comprises an electrically insulating jacket surrounding said first bus and said second bus and a grounding braid surrounding said insulating jacket.

14. The self-regulating heating cable assembly of claim 1 wherein said indicator further comprises an indicator housing.

15. The self-regulating heating cable assembly of claim 14 wherein said indicator housing comprises:

an other-than-round aperture for receiving said self-regulating cable.

16. The self-regulating heating cable assembly of claim 1 wherein said indicator comprises:

an other-than-round aperture for receiving said self-regulating cable, said aperture sized to admit passage of an insulator portion of said self-regulating cable, but not a braided grounding portion of said self-regulating cable.

17. The self-regulating heating cable assembly of claim 1 wherein said indicator comprises:

an other-than-round aperture for receiving said self-regulating cable, said aperture sized to admit said self-regulating cable in a fixed orientation.

18. The self-regulating heating cable assembly of claim 1 wherein said self-regulating cable has an oval cross sectional profile and wherein said indicator comprises an aperture for receiving said self-regulating cable, said aperture having a shape that conforms to said self-regulating cable.

19. The self-regulating heating cable assembly of claim 1 wherein said indicator further comprises an indicator housing and wherein said indicator housing comprises:

a first contact connected to said first bus, and a second contact connected to said second bus.

20. The self-regulating heating cable assembly of claim 19 wherein said first contact penetrates into said self-regulating cable to make an electrical connection with said first bus and said second contact penetrates into said self-regulating cable to make an electrical connection with said second bus.

21. The self-regulating heating cable assembly of claim 1 wherein said indicator further comprises an indicator housing and wherein said indicator housing comprises a first mating portion and a second mating portion and further wherein an indicator light is mounted inside said first and second mating portions.

22. The self-regulating heating cable assembly of claim 1 wherein said self-regulating cable is not more approximately 50 feet.

23. A method of testing a self-regulating heating cable comprising the steps of providing a self-regulating heating cable apparatus comprised of a self-regulating heating cable, a plug coupled to a first end of the self-regulating heating cable, and an indicator coupled to the self-regulating heating cable at a second end of said self-regulating cable, wherein said second end is opposite from said first end;

inserting said plug into an electrical receptacle; and confirming proper operation of said self-regulating heating cable apparatus by operation of said indicator.

24. The method of claim 23 where said indicator is responsive to current flow in said self-regulating cable.

25. The method of claim 23 where said indicator is responsive to a potential across busses of said self-regulating cable.

26. The method of claim 23 wherein said step of confirming is performed regardless of temperature.

27. A self-regulating heating cable assembly comprising:

a self-regulating heating cable adapted to draw increased current at lower temperatures to generate heat therefrom;

a plug coupled to said self-regulating cable at a first end thereof for supplying electricity thereto, said plug adapted for insertion into a conventional electrical receptacle; and an indicator coupled to said self-regulating cable at a second end of said self-regulating cable wherein said second end is opposite from said first end, said indicator responsive to operation of said self-regulating heating cable.

28. An improved heating cable assembly having a length of self-regulating heating cable adapted to draw increased current at lower temperatures to generate heat therefrom, said length of self-regulating heating cable having a first end and a second end opposite said first end, and a plug coupled to said first end for supplying electricity to said length of self-regulating heating cable, wherein the improvement comprises:

an indicator coupled to the self-regulating cable at a location along the length of said length of self-regulating heating cable, said indicator responsive to operation of the self-regulating heating cable.

29. An improved heating cable assembly having a self-regulating heating cable adapted to draw increased current at lower temperatures to generate heat therefrom and a plug coupled to a first end of the self-regulating cable for supplying electricity thereto, wherein the improvement comprises:

an indicator coupled to the self-regulating cable at a second end, wherein said second end is opposite from said first end, and wherein said indicator is responsive to operation of the self-regulating heating cable.

30. A kit of components for assembling a self-regulating heating cable assembly wherein the kit is adapted for use with a self-regulating heating cable adapted to draw increased current at lower temperatures to generate heat therefrom, the kit including:

a plug adapted for coupling to said self-regulating cable at a first end thereof for supplying electricity thereto, said plug also adapted for insertion into a conventional electrical receptacle; and an indicator adapted for coupling to said self-regulating cable at a second end of said self-regulating cable, wherein said second end is opposite from said first end, said indicator responsive to operation of said self-regulating heating cable.

31. The invention of claim 30 wherein said indicator includes an other-than-round aperture for receiving the self-regulating cable.

32. The invention of claim 30 wherein said indicator comprises an aperture for receiving said self-regulating cable in a fixed orientation.

33. The invention of claim 30 wherein said indicator has an aperture having a shape that generally conforms to a profile of the self-regulating cable to receive the self-regulating cable therein.

34. A self-regulating pipe heating cable assembly comprising:

a length of self-regulating cable having a first end and a second end opposite the first end, wherein said length of self-regulating cable is comprised of a first bus, a second bus, and a temperature-sensitive conducting layer between said first bus and said second bus;

a plug coupled to said first end for supplying electricity thereto, said plug adapted for insertion into an electrical receptacle; and an indicator coupled to said self-regulating cable along the length of the self-regulating between said first end and said second end.

35. A method of testing a self-regulating heating cable comprising the steps of:

providing a self-regulating heating cable apparatus comprised of a length of self-regulating heating cable having a first end and a second end, a plug coupled to the first end of the self-regulating heating cable, and an indicator coupled to the self-regulating heating cable at a location between said first end and said second end;

inserting said plug into an electrical receptacle; and confirming proper operation of said self-regulating heating.

36. A self-regulating heating cable assembly comprising:

a length of self-regulating heating cable adapted to draw increased current at lower temperatures to generate heat therefrom, said length of self-regulating heating cable having a first end and a second end;

a plug coupled to said first end of said self-regulating cable for supplying electricity thereto, said plug adapted for insertion into a conventional electrical receptacle; and an indicator coupled to said self-regulating cable at a location between said first end and said second end of said length of self-regulating heating cable, said indicator responsive to operation of said self-regulating heating cable.

* * * * *

UNITED STATES PATENT AND TRADEMARK OFFICE

CERTIFICATE OF CORRECTION

PATENT NO. : 5,818,012

DATED : October 6, 1998

INVENTOR(S) : Daniel A. Maniero

It is certified that error appears in the above-identified patent and that said Letters Patent is hereby corrected as shown below:

On the Title Page item [54], please insert --HEATING-- after "SELF-REGULATING".

In column 1, line 1, please insert --HEATING-- after "SELF-REGULATING".

In claim 22, line 2, please insert --than-- after "more".

In claim 23, line 2, please insert --:-- (colon) after "of".

In claim 27, line 10, please insert --,-- (comma) after "cable".

Signed and Sealed this

Tenth Day of April, 2001

*Attest:*

Nicholas P. Godici

NICHOLAS P. GODICI

*Attesting Officer*

*Acting Director of the United States Patent and Trademark Office*